United States Patent [19]

Coffin

[11] 4,174,708

[45] Nov. 20, 1979

[54] BACK MASSAGER

[76] Inventor: Harry A. Coffin, 2811 Stevens Ave. South, Apartment 5C, Minneapolis, Minn. 55407

[21] Appl. No.: 846,996

[22] Filed: Oct. 31, 1977

[51] Int. Cl.[2] ..... A61H 7/00

[52] U.S. Cl. ..... 128/49

[58] Field of Search ..... 128/32, 48-52, 128/24 R, 55, 33, 44, 24.2

[56] References Cited

U.S. PATENT DOCUMENTS

| | | | |
|---|---|---|---|
| 721,737 | 3/1903 | Owens | 128/49 |
| 860,669 | 7/1907 | Johansen | 128/32 |
| 1,712,521 | 5/1929 | Rothchild et al. | 128/52 X |
| 2,206,902 | 7/1940 | Kost | 128/46 |
| 2,350,098 | 5/1944 | Decker | 128/49 UX |
| 2,424,699 | 7/1947 | Marty | 128/24.2 |
| 2,427,053 | 9/1947 | Hampton | 128/52 |
| 2,827,894 | 3/1958 | Meyers | 128/25 B |
| 2,910,060 | 10/1959 | Werner et al. | 128/33 |
| 2,939,454 | 6/1960 | Lichtenstein et al. | 128/33 |
| 3,044,462 | 7/1962 | Leufvenius | 128/25 B |
| 3,062,205 | 11/1962 | Loiacano | 128/33 |
| 3,075,519 | 1/1963 | Wright | 128/49 |
| 3,640,272 | 2/1972 | Hussey | 128/33 |
| 3,727,607 | 4/1973 | Dill | 128/33 |
| 3,732,860 | 5/1973 | Thurmer | 128/33 |
| 4,006,739 | 2/1977 | Wahl | 128/33 |

*Primary Examiner*—Lawrence W. Trapp

*Attorney, Agent, or Firm*—Merchant, Gould, Smith, Edell, Welter & Schmidt

[57] ABSTRACT

An improved back massager for creating a new massaging action in the form of angular oscillatory motion in a single plane. The angular oscillatory motion is created through the use of a drive mechanism carried by a base frame which imparts the oscillatory motion to a massaging applicator. Additional apparatus is also provided for preventing undue deviation of the massaging applicator from the oscillating plane and for creating massaging action in addition to the oscillatory motion.

7 Claims, 15 Drawing Figures

BACK MASSAGER

BACKGROUND OF THE INVENTION

This invention relates to massaging apparatus for massaging the human body, in particular, the back.

Devices for therapeutic application of force to the human body use several different kinds of motion to cause rubting, vibrating, and massage. For example, it is known to use a back and forth rubbing motion as disclosed in the patent to Hampton U.S. Pat. No. 2,427,053. It is also known to use vibratory motion as exemplified by the patents to Lichtenstein et al, U.S. Pat. No. 2,939,454 and Wahl, U.S. Pat. No. 4,006,739. Furthermore, it is known to use a back and forth rolling motion and/or tilting motion as disclosed by the patent to Werner et al, U.S. Pat. No. 2,910,060. It is also known to use gyrating or wobbling motion as exemplified by the patents to Kost, U.S. Pat. No. 2,206,902, Leufvenius, U.S. Pat. No. 3,044,462, and Applicant's copending abandoned application Ser. No. 694,169 filed June 9, 1976.

SUMMARY OF THE INVENTION

The Applicant has invented a new and useful unit for massaging the human body, in particular the back, through the use of angular oscillatory motion in a single plane. More particularly, the instant application discloses the means for creating the novel oscillatory motion. The novel oscillatory motion of the instant invention is created through the use of a drive means carried by a base frame which imparts the novel oscillatory motion to a massaging applicator. Furthermore, additional means are provided for preventing undue deviation of massaging applicator from the oscillating plane and for creating additional massaging action.

Various advantages and features of novelty which characterize the instant invention are pointed out with particularity in the claims annexed hereto and forming a part hereof. However, for a better understanding of the instant invention, its advantages, and objects attained by its use, reference should be had to the drawings which form a part hereof and to the accompanying descriptive matter, in which there is illustrated and described preferred embodiments of the instant invention.

DESCRIPTION OF THE PREFERRED EMBODIMENTS OF THE INVENTION

Figure 1:
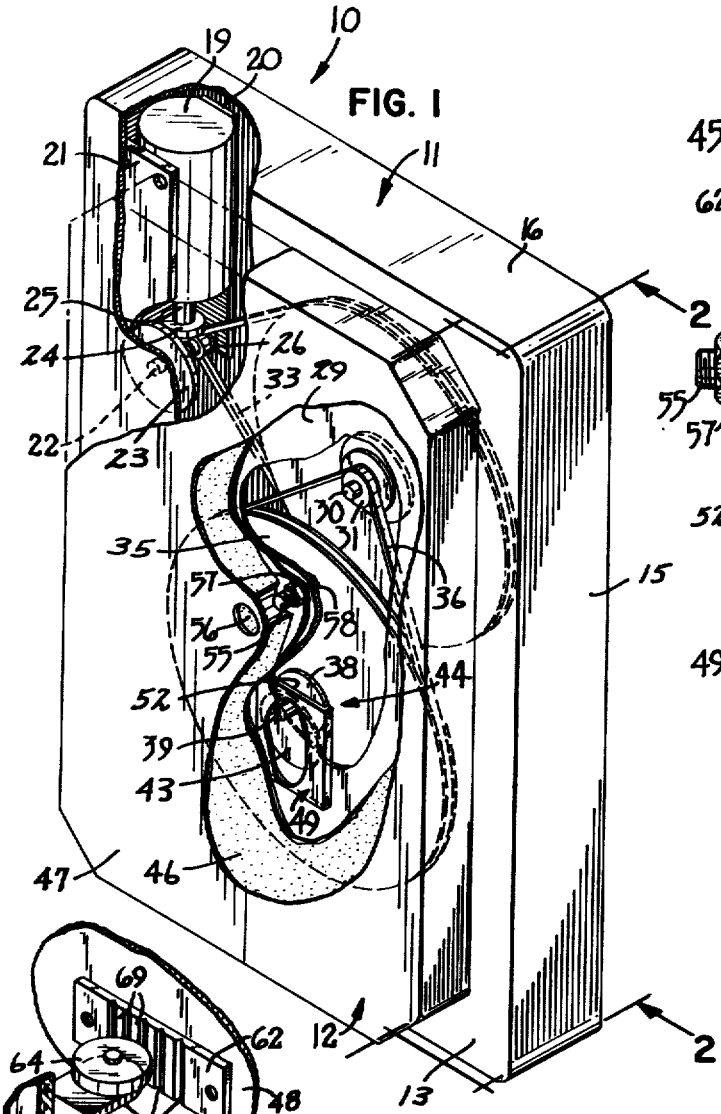
FIG. 1 is a view of the invention in perspective with parts broken away and structure shown in sections.

Referring to FIGS. 1-3 and 15, a massaging unit 10 according to the instant invention is generally composed of a rectangular base frame 11 and a massaging applicator 12. The base frame 11 is composed of a top member 13, a bottom member 14 and sides 15-18. Near one corner of the base frame 11 is a motor 19 attached in the base frame by means not shown. Attached to the top and bottom of the motor 19 are two rectangular plates 20, 21 between which a shaft 22 is rotatably supported. Near rectangular plate 21, a driven disc 23 is secured to the shaft 22, the face of this disc 23 frictionally engaging the edge of a smaller driving disc 24 secured to a shaft 25 extending from and driven by the motor 19. At the other end of shaft 22 near the rectangular plate 20 is secured a first small pulley 26 which acts through a first belt 33 to drive a first large pulley 29 mounted on a first shaft 30 for rotation in a suitable bearing, not shown, carried by top member 13. A second small pulley 31 mounted on shaft 30 acts through a second belt 36 to drive a second large pulley 35 mounted on a second shaft 39 for rotation in a suitable bearing 38 carried by top member 13. Shaft 39 extends outward through top member 13, and its outer end may be releasably secured in any one of a plurality of spaced holes 40, 41, or 42 which are offset at varying distances from the center of a circular member 43 to form an eccentric 44.

Figure 4:
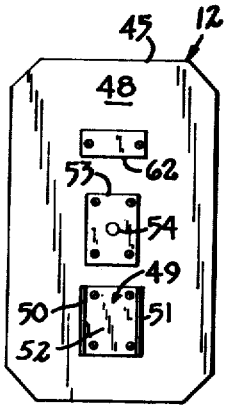
FIG. 4 is a sectional view of the invention to a smaller scale along line 4—4 of FIG. 2.

As shown in FIG. 4, the massaging applicator 12 is generally composed of a stiff backing 45 covered by an inner layer of resilient material 46 and a suitable outer cover 47. Attached near one end of the inner surface 48 of the stiff backing 45 is a rectangular structure 49 having two outwardly extending parallel walls 50, 51 defining a channel 52, the width of which is substantially the same as the diameter of member 43. Attached by suitable fasteners near the center of the backing 45 is a rectangular plate 53 having a hole 54 in the center thereof, the hole 54 also extending through the backing 45.

Figure 2:
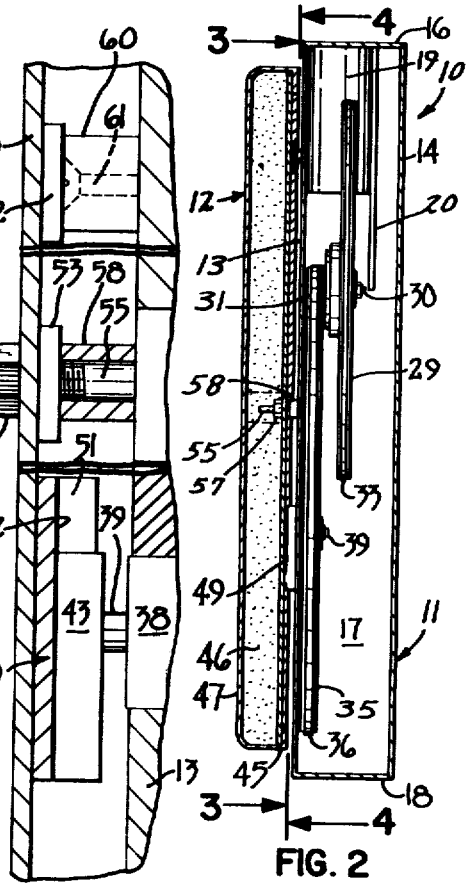
FIG. 2 is a sectional view taken along the irregular line 2—2 of FIG. 1.
Figure 15:
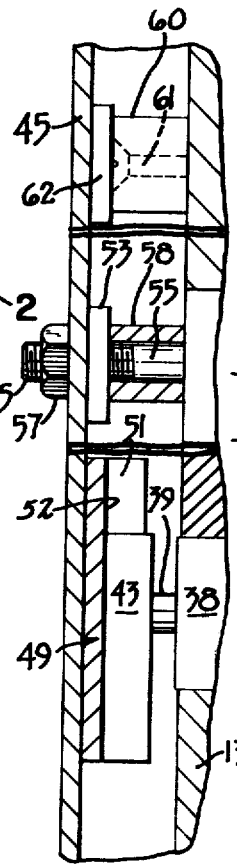
FIG. 15 is an enlarged view of the middle of FIG. 2 with parts broken away which shows the interconnection of the base frame and the massaging applicator.

As shown in FIGS. 1-2 and 15, the massaging applicator 12 is mounted on a shaft 55 which is pivotally supported by the top member 13. Shaft 55 extends through the hole 54 in the rectangular plate 53 and the backing 45 into a cavity 56 in inner layer 50 and is secured by means of a nut 57. As shown in FIG. 15, the massaging applicator 12 is secured to the shaft 55 so that the rectangular structure 49 slidably fits over member 43, the walls 50, 51 of the rectangular structure 49 being in sliding contact with the periphery of member 43. A spacer 58 is mounted on shaft 55 to position backing 45 far enough from member 13 so that the face of circular member 43 is very close to or lightly engages the bottom of channel 52. When force is applied against the padded surface of the applicator, it is resisted at the center of the applicator by engagement of spacer 58 with plate 53, and below the center of the applicator by engagement of the surface of circular member 43 with the end of shaft 39 and the bottom of channel 52.

Figure 7:
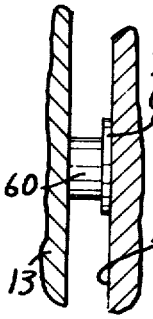
FIG. 7 is a detailed view which shows one component of another means for preventing undue deviation of the massaging applicator from the oscillating plane.
Figure 3:
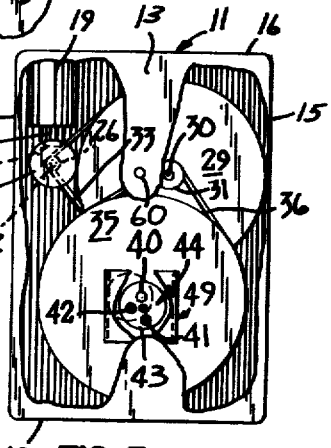
FIG. 3 is a sectional view of the invention to a smaller scale along line 3—3 of FIG. 2 with parts broken away.

As shown in FIGS. 7 and 15, a cylindrical shoe 60, which is attached to top member 13 by means of a suitable fastener 61, slidably engages a rail 62 preferably attached to the side of the backing 45 away from rectangular structure 49. The purpose of shoe 60 is to prevent undue deviation of the massaging applicator 12 from the oscillating plane. If desired, oil or some other lubricant may be applied to shoe 60 so that it slides easier while engaging rail 62.

Figure 6:
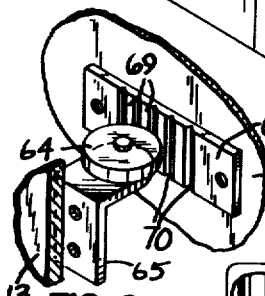
FIG. 6 shows an arrangement for preventing undue deviation of the massaging applicator from the oscillating plane.

As shown in FIG. 6, shoe 60 of FIG. 7 may be replaced by a roller 64 attached by a bracket 65 to top member 13 for engaging rail 62. Furthermore, rail 62 may include a plurality of parallel ridges 69 formed by grooves 70 in rail 62. When roller 64 moves across ridges 69, vibratory motion is created. It should be understood that a pair of rollers 64 could be utilized to engage a pair of rails 62. The other rail 62 would preferably be positioned slightly below structure 51 near one end of backing 45. However, it is preferred that only one of the pair of rails 62 have ridges 69 because a pair of rails having such ridges would create mutually destructive motion which is undesirable. It should also be understood that, although rollers 64 may be attached to top member 13, they may also be attached to backing 45 of the massaging applicator 12, the rails 62 then being attached to top member 13.

Figure 8:
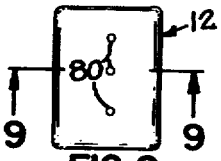
FIG. 8 illustrates another embodiment of the massaging applicator.
Figure 9:
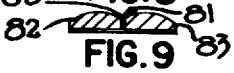
FIG. 9 is a sectional view taken along line 9—9 of FIG. 8.

As shown in FIGS. 8–9, the massaging applicator 12 may include a plurality of buttons 80 down the middle of the massaging applicator to create a hollow area 81 and two padded ridges 82, 83 which conform to the back of the user of the massaging unit.

Figure 11:
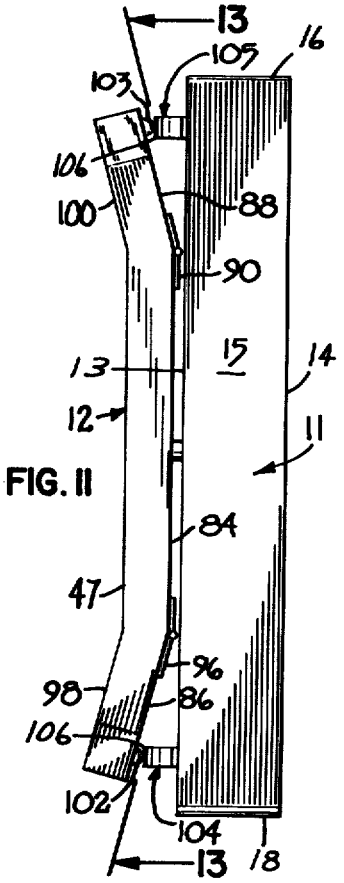
FIG. 11 is a side view of the massaging unit of FIG. 10 and illustrates the means for creating additional massaging action.
Figure 14:
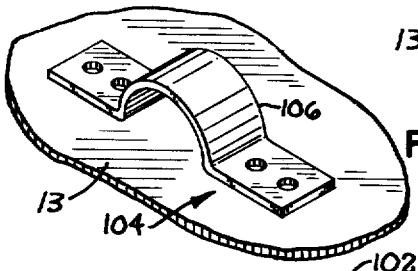
FIG. 14 is a detailed view which shows part of the means for creating additional massaging action.
Figure 12:
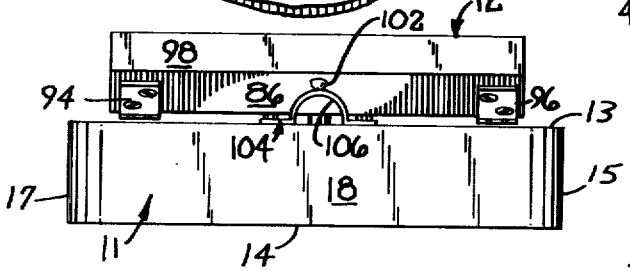
FIG. 12 is an end view of the massaging unit of FIG. 10.
Figure 13:
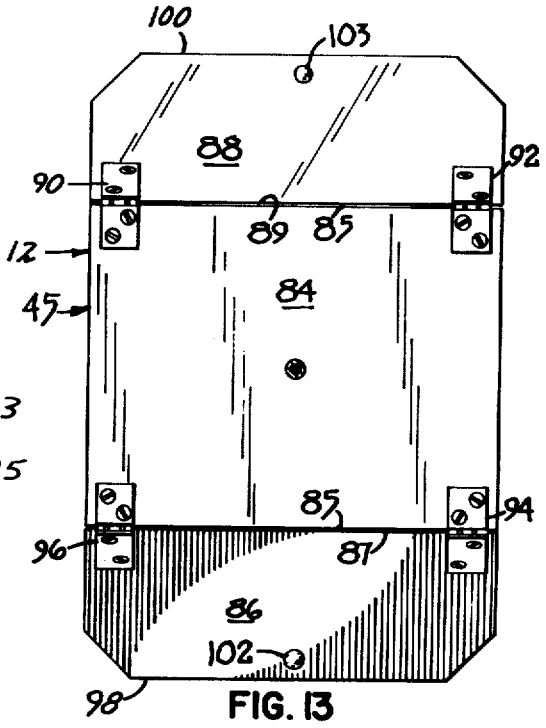
FIG. 13 is a sectional view taken along irregular line 13—13 of FIG. 11.

As shown in FIG. 13, the stiff backing 45 of the massaging applicator 12 may be composed of a central portion 84 and two end members 86, 88 which are attached to the central portion by means of hinges 90, 92, 94 and 96 to form pivoted outer ends 98, 100. Because pivotal movement about the hinges is restricted in the upward direction by interfering contact between the edges 87, 89 of end members 86, 88 and edges 85 of central portion 84 and in the downward direction by upward biasing of outer cover 47, the massaging applicator 12 remains generally rigid except when a biasing force is applied downwardly on outer ends 98, 100 or upwardly to end members 86, 88. As can be seen in FIGS. 11–12, the end members 86, 88 are inclined upwardly from central portion 84 so that in place of the rollers 64, and rails 62 protruding members 102, 103 may be attached to end members 86, 88. In addition, two rails 104, 105 having central parts 106 of a generally convex U-shaped configuration as shown in FIG. 14 are attached to the top member 13 so that the protruding members 102, 103 contact the U-shaped central parts 106 during the sweep of the massaging applicator 12 as the massaging applicator rotates about the shaft 55. It should be understood that, as in the case of the roller-rail combinations, protruding members 102, 103 could be attached to top member 13 with the rails 104, 105 then being attached to end members 86, 88.

IN OPERATION

When the motor 19 is turned ON, the shaft 25 turns, causing disc 23 to rotate due to friction with small driving disc 24. This in turn causes the small pulley 26 to drive large pulley 29 by means of belt 33, the smaller pulley 31 further driving the second large pulley 35 by means of the second belt 36.

As the second large pulley rotates, the circular member 43 slidably rotates in eccentric manner within the channel 52 while contacting the walls 50, 51 of the rectangular structure 49, thereby imparting an angular oscillatory motion to the massaging applicator 12 in a single plane through the axis formed by the shaft 55. The various positions of massaging applicator 12 during the oscillatory motion are shown in FIG. 5.

Figure 5:
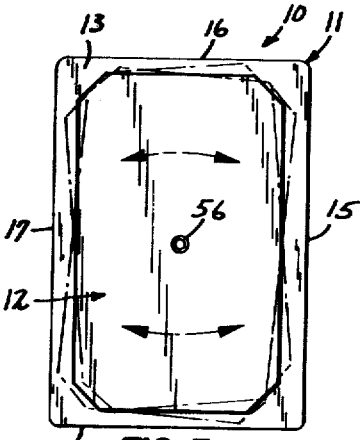
FIG. 5 illustrates by broken lines the respective positions of the massaging applicator during oscillatory motion.
Figure 10:
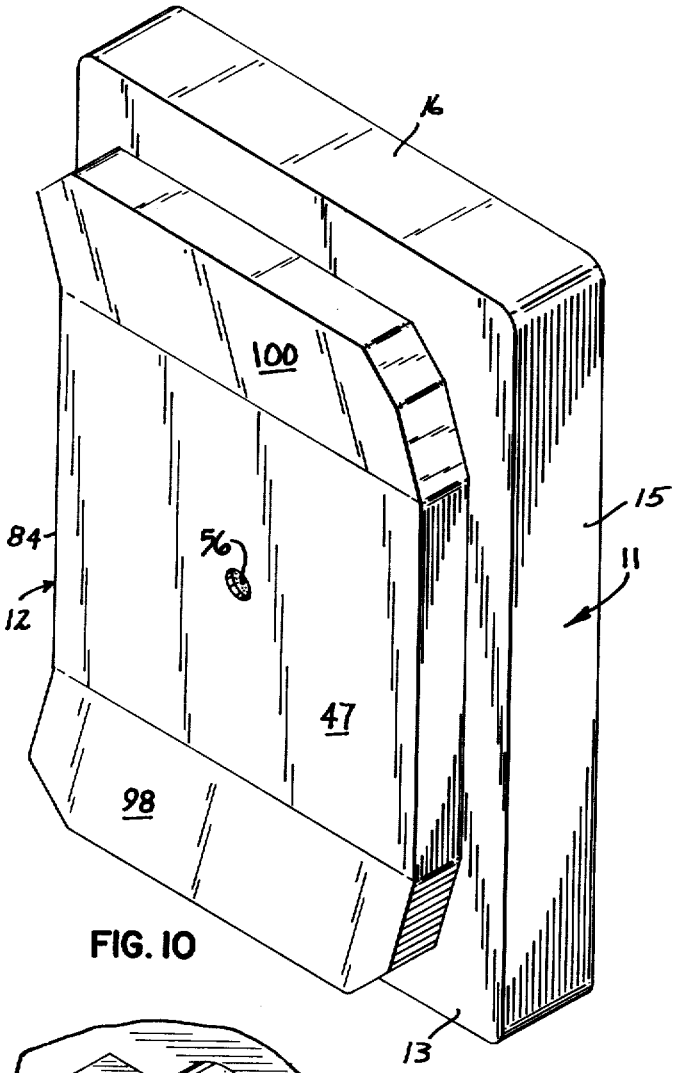
FIG. 10 is another embodiment of the massaging unit of the instant invention in perspective.

As the massaging applicator 12 oscillates, the rollers 64, or shoe 60, which limit undue deviation by the massaging applicator from the oscillating plane, engage rails 62 in an arcuate path as shown by the dotted arrows in FIG. 5. The roller engaging the rail 62 having a plurality of parallel ridges 69 creates additional massaging action through vibratory motion as it rotates in a path transverse to these ridges.

When backing 45 of the massaging applicator 12 is composed of two end members 86, 88 pivotally connected to the central portion 84, the oscillation of the massaging applicator causes the protruding members 102, 103 to contact the U-shaped central parts 106 of the rails 104, 105, thereby creating pivotal movement of the outer ends 98, 100 transverse to the oscillating plane. If desired, the person using the instant invention may vary the amount of pivotal movement of the ends 98, 100 by leaning back with greater or lesser force against the massaging applicator 12, so that end members 86, 88 are biased towards or away from the rails 104, 105. As a result, the protruding members 102, 103 contact more or less of the U-shaped central parts 106 during the oscillatory sweep of the massaging applicator 12, thus increasing or decreasing the amount of pivotal movement of the outer ends 98, 100 and thereby increasing or decreasing the amount of massaging action transverse to the oscillating plane.

From the foregoing description, it will be apparent that the instant invention produces a new form of massaging action in the form of angular oscillatory motion in a single plane by use of an eccentric slidable rotating within a channel attached to or formed in a massaging applicator, and including additional means for preventing undue deviation from the oscillating plane or for creating additional massaging action.

Numerous characteristics and advantages of the instant invention have been set forth in the foregoing description, together with details of the structure and function of the invention, the novel features thereof are pointed out in the appended claims. The disclosure, however, is illustrative only, and changes may be made in detail, especially in matters of shape, size, and arrangement of the parts, within the principle of the invention to the full extent indicated by the broad general meaning of the terms in which the appended claims are expressed.

I claim:

1. A massaging unit, comprising, in combination:

a massaging applicator;

a base frame;

means for mounting said applicator for pivotal movement with respect to said base frame;

drive means carried by said base frame for imparting angular oscillatory motion to said massaging applicator in a single plane about said mounting means, said massage unit including means between said base frame and said massaging applicator for limiting deviation of said massaging applicator from the oscillating plane, said means for limiting said deviation including rollers carried by one of said massaging applicator and said base frame, engaging rails carried by the other of said massaging applicator and said base frame, at least one of said rails including a plurality of ridges extending transverse to the path of one of said rollers.

2. A massaging unit, comprising, in combination:

a massaging applicator;

a base frame;

means for mounting said applicator for pivotal movement with respect to said base frame;

drive means carried by said base frame for imparting angular oscillatory motion to said massaging applicator in a single plane about said mounting means; and said massaging applicator including outer ends pivoted about axes lying in said oscillating plane.

3. Apparatus according to claim 2, including means between said massaging applicator and said base frame structure for imparting pivotal movement to said outer ends transverse to said oscillating plane when said massaging applicator oscillates.

4. Apparatus according to claim 3, wherein said means for imparting said pivotal movement includes rails carried by one of said massaging applicator and said base frame, each of said rails having a central part of generally convex U-shaped configuration, and protruding members carried by the other of said massaging applicator and said base frame, said protruding members contacting said rails during said oscillatory motion.

5. In a massaging unit, including, in combination, a massaging applicator;

a base frame;

means for mounting said applicator for pivotal movement with respect to said base frame;

an eccentric carried by said base frame;

a motor carried by said base frame;

mechanical means connected to said motor for driving said eccentric;

rollers carried by one of said base frame and said massaging applicator;

rails engaging said rollers and carried by the other of said base frame and said massaging applicator;

ridges in one of said rails extending transverse to the path of one of said rollers:

the improvement which comprises means for defining a channel carried by said massaging applicator within which said eccentric slidably rotates to impart angular oscillatory motion to said massaging applicator in a single plane as it moves about said mounting means.

6. A massaging unit, comprising, in combination:

a resiliently covered massaging applicator, including a stiff backing and two padded ridges divided by a hollow area;

a base frame;

an eccentric carried by said base frame, including a circular member having a plurality of spaced holes offset at varying distances from the center of said circular member, and a first shaft releasably secured in any one of said holes;

a second shaft secured to said massaging applicator and rotatably supported by said base frame;

a structure attached to said stiff backing and having two outwardly extending parallel walls defining a channel within which said circular member slidably rotates in an eccentric manner, said circular member contacting said parallel walls to impart angular oscillatory motion to said massaging applicator in a single plane about said second shaft;

a motor in said base frame;

belt and pulley means connecting said motor to said first shaft for imparting said eccentric rotation to said circular member;

rollers attached to said base frame;

rails connected to said massaging applicator and engaging said rollers; and a plurality of ridges in one of said rails extending transverse to the path of one of said rollers.

7. A massaging unit, comprising, in combination:

a resiliently covered massaging applicator having a stiff backing, said stiff backing having a central portion and two end members pivotally connected to said central portion to define pivoted outer ends of said massaging applicator;

a base frame;

an eccentric carried by said base frame, including a circular member having a plurality of spaced holes offset at varying distances from the center of said member, and a first shaft releasably secured in any one of said holes;

a second shaft secured to said massaging applicator and rotatably supported by said base frame structure for pivotal movement of said applicator;

a structure attached to said stiff backing and having two outwardly extending parallel walls defining a channel within which said circular member slidably rotates in an eccentric manner, said circular member contacting said parallel walls to impart angular oscillatory motion to said massaging applicator in a single plane about said second shaft;

a motor in said base frame;

belt and pulley means connecting said motor to said first shaft for imparting said eccentric rotation to said circular member;

rails attached to said base frame, each of said rails having a generally U-shaped convex central part; and protruding members attached to said end members of said stiff backing, said protruding members contacting said central part of said rails during said oscillatory motion of said massaging applicator to impart limited pivotal movement to said outer ends.

* * * * *